United States Patent [19]

Sherman et al.

[11] 4,162,933

[45] Jul. 31, 1979

[54] EXOTHERMIC HEAT AS A MEANS OF DETERMINING THE DEGREE OF DELIGNIFICATION

[75] Inventors: Michael I. Sherman; James R. Prough, both of Glens Falls, N.Y.

[73] Assignee: Kamyr Inc., Glens Falls, N.Y.

[21] Appl. No.: 813,648

[22] Filed: Jul. 7, 1977

Related U.S. Application Data

[63] Continuation of Ser. No. 722,414, Aug. 24, 1976, abandoned, which is a continuation of Ser. No. 555,269, Mar. 4, 1975, abandoned, which is a continuation of Ser. No. 360,472, May 15, 1973, abandoned.

[51] Int. Cl.[2] ..... D21C 3/24

[52] U.S. Cl. ..... 162/17; 23/230.3; 73/15 R; 73/32 R; 73/190 R; 73/190 H; 73/190 CV; 162/49; 162/61; 162/DIG. 10

[58] Field of Search ..... 162/17, 38, 49, 61, 162/62, 237, 238, 242, 246, 263, DIG. 10; 23/230 R, 230 A, 230.3, 253 R, 253 A; 250/303, 356, 358 R, 362, 364, 573, 358 P; 73/15 R, 15 B, 32 R, 61 R, 61.1 R, 63, 190 R, 190 H, 190 CV, 193 R, 193 A, 194 R, 198, 339 R, 343 R, 344

[56] References Cited

U.S. PATENT DOCUMENTS

| | | | |
|---|---|---|---|
| 1,831,206 | 11/1931 | Swanson et al. | 162/238 X |
| 2,395,357 | 2/1946 | Trawick | 162/238 X |
| 2,858,213 | 10/1958 | Durant et al. | 162/238 X |
| 3,085,624 | 4/1963 | Horstman | 162/238 X |
| 3,802,956 | 4/1974 | Backlund | 162/237 X |

OTHER PUBLICATIONS

Boozer et al., "Automatic Control of a Kraft Continuous Digester", Paper Trade Journal, 6-11-62, pp. 42-46.

Grant, "Computer Applications: Woodlands Through Bleach Plant-II", Paper Trade Journal 6-21-71, pp. 36-41.

MacLoed, "Autocook System Brings Full Automation to Batch Digesters", Paper Trade Journal, 8-16-71, pp. 36-39.

Morrison, "Changes in Kraft Continuous Digester Instrumentation", Paper Trade Journal, 9-14-64, pp. 47-51.

Hubbe, "Digester Problem Statement", Tappi Journal, 5-1966, vol. 49, No. 5, pp. 61A-69A.

*Primary Examiner*—Arthur L. Corbin

*Attorney, Agent, or Firm*—Cushman, Darby & Cushman

[57] ABSTRACT

A process for continuously digesting cellulosic fibrous material wherein the degree of delignification of the cellulosic fibrous material in the digestion zone is continuously determined and monitored by determining the exothermic heat of the delignification reaction taking place in the digester. The exothermic heat of the delignification reaction is determined by measurements of the temperature rise occurring in the delignification zone and the heat capacity of the cellulosic material and digesting liquor.

5 Claims, 1 Drawing Figure

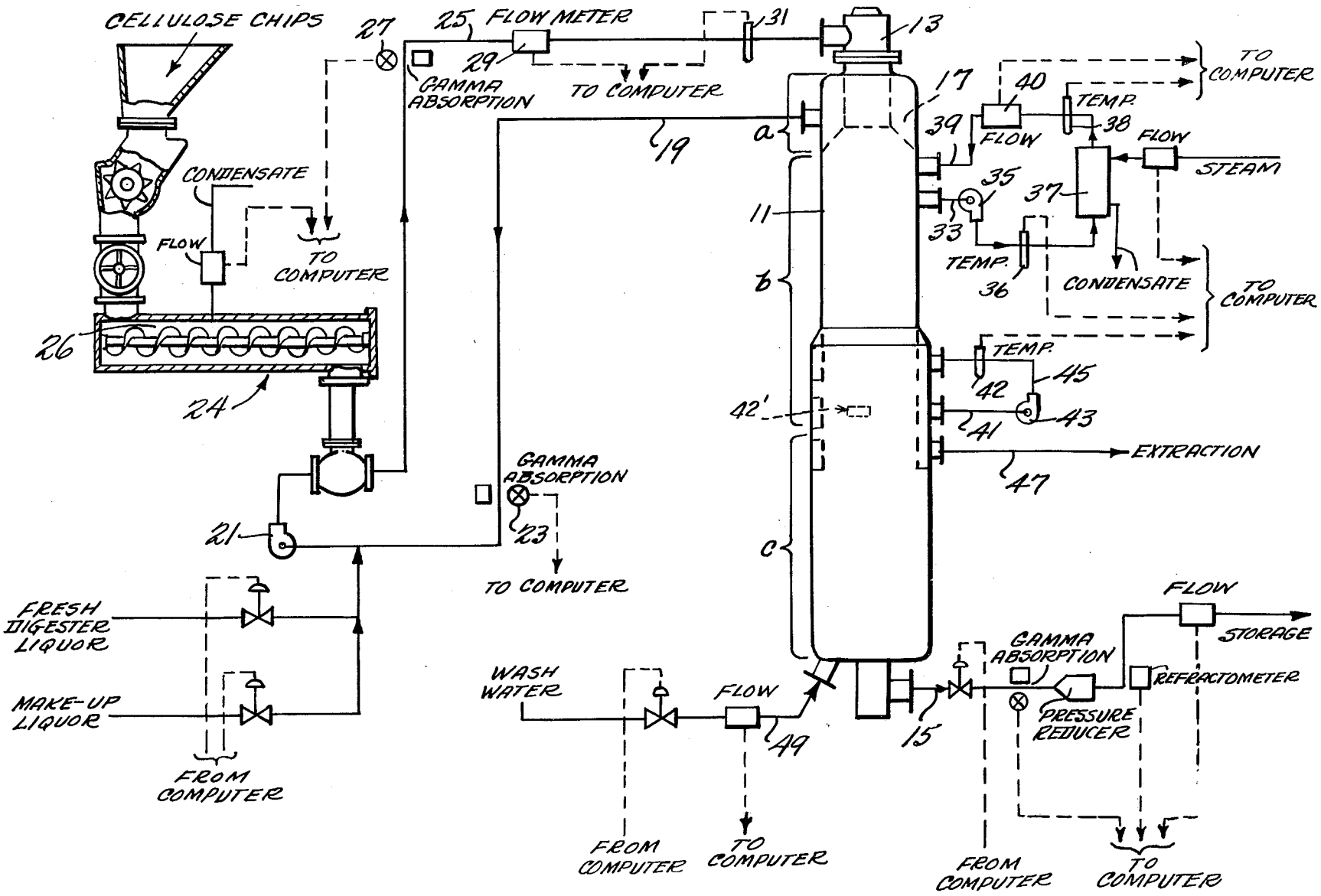
TO COMPUTER
STEAM
FLOW
TEMP.
CONDENSATE
EXTRACTION
STORAGE
REFRACTOMETER
GAMMA ABSORPTION
PRESSURE REDUCER
FROM COMPUTER
FLOW METER
CELLULOSE CHIPS
WASH WATER
FRESH DIGESTER LIQUOR
MAKE-UP LIQUOR

EXOTHERMIC HEAT AS A MEANS OF DETERMINING THE DEGREE OF DELIGNIFICATION

The present application is a continuation of application Ser. No. 722,414, filed Aug. 24, 1976, now abandoned, which, in turn, is a continuation of Ser. No. 555,269, filed Mar. 4, 1975, now abandoned, which, in turn, is a continuation of Ser. No. 360,472, filed May 15, 1973, now abandoned.

The present invention relates to a novel process and means for controlling variables in a continuous process for digestion of cellulose such as described in U.S. Pat. Nos. 3,041,232 and No. 3,200,032. More specifically, the present invention contemplates a method and apparatus for determining the degree of delignification of the cellulose material in the digester by measuring the increase in temperature occurring in the cooking zone of the digester. The invention is based on the finding that the magnitude of the temperature rise in the cooking zone, due to the exothermic digestion reaction taking place therein, is a reliable and accurate way of measuring the rate of reaction or degree of delignification in the digester.

The present invention is particularly advantageous for use with a digester system of continuously monitoring and controlling a continuous process for digestion of cellulose utilizing means programmed to determine (1) the mass of wood fed to the digester, (2) the mass of pulp solids being withdrawn from the digester, (3) the desired amount of chemicals to be fed to the digester and (4) the desired temperature of the reaction zone of the digester.

The total mass of pulp slurry flowing from the digester in continuously monitored by a gamma absorption device and by a flow measurement. Additionally, the total mass of liquid in the digester effluent is continuously measured by a refractometer. The gamma absorption device determines the density of the pulp slurry by measuring the amount of gamma particles absorbed by the slurry. the refractometer determines the density of the liquid portion of the slurry along the total mass measurement by measuring the refractive index of the liquor. These measurements may be continuously fed to a computer which, in turn, is programmed to adjust the amount of wood chips, water and digesting liquor fed to the digester as necessary to maintain the desired solids content in the digester product.

The combination of gamma absorption device, refractometer and flow measurement device nicely serves to differentiate the composition of the slurry or effluent from the digester, and thus is extremely beneficial towards automatic control of the digester operation. Quite unexpectedly, the gamma absorption device and refractometer give reliable and accurate measurements of the density of a pulp slurry and the liquid portion of the slurry, respectively, even though the densities of the solid and liquid involved are not greatly different and the solids are not separated from the liquid in the slurry prior to measurement with the refractometer.

Also, a gamma absorption device may be used to accurately monitor the amount of wood chips fed to the digester. One of the principal sources of process variation in the digester is the non-uniformity of wood chip loading. The chip meters used to feed the chip to the digester are usually volume type meters wherein a controlled volume of chips is obtained. The accurate measurement of chip volume allows the control of residence time or cooking time in the digester (that is, if the effluent from the digester is controlled effectively). However, due to non-uniformity of the chip composition, such as size distribution of chip particles and porosity of the chip, the volumetric control does not produce a uniform mass of chips entering the digester. The modification proposed herein permits continuous measurement of the mass of the wood which is fed to the digester and thus offers a closer control on the digestion than hitherto possible. Briefly stated, the measurement of wood chips fed to the digester is correlated with the amount of digesting liquor fed to the digester so that the amount of liquor is controlled and adjusted as necessary to accomodate for any variation in the amount of wood chips fed to the digester.

The accurate monitoring of wood chips fed to the digester is accomplished by measuring the difference in density of the liquor flow feeding the chip to the digester before and after the chips have been introduced therein. As described in U.S. Pat. No. 3,041,232, the chip is characteristically charged first into a feed conduit and carried by liquor which is circulating therein into the digester. The digester liquor is then separated from the fiber material and the liquor returned to the circulation conduit. The density of the liquor is measured by a gamma absorption device just prior to when the chips are introduced therein and again just after the chips have been introduced. The resulting density measurements may then be fed, along with a total flow measurement, to a computer which is programmed to modify the amount of fresh digester liquor fed to the system based on the amount of wood chips determined by the density and flow measurements. Here again, the excellent control of wood and fresh digester liquor resulting from the use of a means including a gamma absorption device is quite unexpected, as it could not have been predicted that there could be a significant and meaningful density variation between the digester liquor without chips and the digester liquor containing the wood chips to give an indication of amount of wood chips supplied in unit time.

One may combine the use of the gamma absorption device on both the wood feed to the digester and the pulp effluent from the digester in combination with flow measurements in each line and also a refractometer on the effluent from the digester. All these measurements may be fed to a computer which, in turn, provides for the correct amount of fresh digester liquor to be fed to the digester, the correct temperature to be maintained in the digester and correct flow rate of effluent from the digester.

The correct temperature and time for proper delignification has been determined in the prior art by empirical relationships. In the conventional prior art continuous digester, following the cellulose material fed to the digester and the impregnation zone wherein the cellulose material is impregnated with the digesting liquor, there is at least one and possibly two heating zones which bring the cellulose and liquor up to the cooking or delignification temperature. Following the heating zone or zones, the cellulose and liquor remain at the cooking or delignification temperature for a time period required to complete the desired delignification. As mentioned above, the practice has been to determine the prior temperature and time from empirical relationships. The correctness of the time and temperature at which the cellulose and liquor are allowed to cook is determined by testing the product produced. This procedure has several disadvantages. The temperature is usually controlled at a predetermined set point and no adjustment is made for change in the properties of the cellulose feed material. The procedure for determining the correctness of the cooking time and temperature involves a rather lengthy delay and, therefore, the correct time and temperature and subsequently the proper degree of delignification for the particular cellulose being cooked is never really accomplished.

It has now been found that the degree of delignification can be determined continuously and contemporaneously with the cooking of the cellulose material. The cooking or delignification reaction is exothermic and thus there is a temperature rise in the cooking zone of the digester. The magnitude of this temperature rise in the cooking zone has been found to be proportioned to the rate of delignification at any given production rate and at steady condition, this measurement of the temperature rise gives a reliable instantaneous and continuous indication of the degree of delignification being accomplished in the digester.

In addition, it has also been found that the measurement of the temperature rise in the cooking zone of the digester can be effectively combined in a computer control system Computer control systems for continuous digesters are well known in the art, such as the computer control system at Gulf States Paper Corporation at Demopolis, Ala. and such computer control systems are readily adaptable to computing a wide variety of outputs from given inputs to control further process functions. Computer control per se does not, however, form any part of the present invention. In such a scheme, the temperature rise of the cellulose and liquor in the cooking zone of the digester is fed to the computer along with measurements of the digester liquor fed, wash water flow to the digester makeup water or black liquor feed to the digester, effluent flow from the digester, the density of liquor portion of the effluent flow from the digester and the density of the effluent flow from the digester. In addition, the computer will be fed the amount of steam used to heat the cellulose material and liquor in the heating zone of digester and the temperature increase obtained.

The computer is programmed to determine the apparent heat capacity of the cellulose and liquor slurry in the digester, and the computer will also be programmed so as to control the cellulose feed rate, digester liquor feed rate, makeup water or black liquor feed rate and the effluent withdrawn from the digester. The control of the feed and withdrawal of materials from the digester will insure that a constant preset mass of material will be moving through the reactor. The computer is programmed to determine the exothermic heat produced. The amount of exothermic heat produced is proportional to the degree of delignification and thus the degree of delignification can be determined.

The invention is more fully explained with reference to the accompanying drawing which diagrammatically illustrates a preferred embodiment of the digesting plant and process according to the invention.

Referring to the illustrated embodiment shown in the drawing, the numeral 11 designates an upright cylindrical digester of essentially uniform cross-sectional area, and a length equal to about ten times the diameter. At its upper end, the digester is provided with appropriate charging or inlet means 13 or a type well known in the art, for example, as shown in U.S. Pat. No. 2,459,180, utilizing a screw conveyor in the charging device which is shown in more detail in U.S. Pat. No. 2,459,180. A slurry of comminuted cellulosic material, such as wood chips suspended in digester liquor, is charged by the means 13 into the digester continuously. The thus charged cellulosic material moves as a compact column vertically downward through the digester and is discharged as a slurry of digested pulp suspended in water into conduit 15 by means of a suitable discharging device, such as that shown in U.S. Pat. No. 2,938,824. During its passage through the digester, the cellulosic material is subjected to various treatment areas which are indicated as the separate zones a, b, and c, respectively.

In the first comparatively short zone a, impregnation of the wood chips or cellulosic fiber material takes place between the digesting liquor and the chips. The digesting liquor preferably consists of sulphate lye, e.g., sodium or calcium sulphate lye.

A sieve 17 is located at the upper end of the digester which separates the wood chips from at least part of the digester liquor and the separated digester liquor is removed in conduit 19. The withdrawn digester liquor flows via conduit 19 to the intake of pump 21. A gamma absorption device 23 is situated on the conduit 19 between the digester 11 and pump 21. This device measures the amount of gamma absorption of the digester liquor and sends this information to a computer, which is not shown in the drawing. The computer determines the density of the digester liquor flowing in conduit 19 from the measurement of its gamma absorption. Fresh digester liquor and make-up black liquor are fed to the digester liquor in conduit 19 between the gamma absorption device and the intake of pump 21. The flow of fresh digester liquor and make-up black liquor are controlled by the computer as more fully disclosed hereinafter.

The digester liquor is then cycled by pump 21 through a wood chip feeding device 24. Such a device is described in U.S. Pat. No. 3,041,232. Wood chips are fed to the circulating digester liquor by feeding device 24, and then the slurry of chips and liquor is fed by conduit 25 to the feeding device 13 on the top of digester 11. The gamma absorption device 27, a flow meter 29 and a temperature sensing device 31 are located in conduit 25 between the chip feeder 24 and the digester 11. The gamma absorption device measures the gamma ray absorption of the wood chip, liquor slurry and sends such measurement to a computer. The flow measurement and the temperature measurement are also fed to the computer. The computer is programmed to determine the density of the liquor flowing in conduit 19 and the density of the slurry of wood chips and liquor flowing in conduit 25. The computer is further programmed to determine from the difference in densities of the liquor and slurry, the mass of wood chips being fed to the digester.

In the drawing, the wood chip feeding device 24 has combined therein a steaming chamber 26. The condensate fed to the chamber 26 is measured and this measurement introduced into the computer to be used in the mass balance of the digester.

The wood chip liquor slurry is fed to the top of the digester 11 and progresses slowly down the column under the action of gravity. As explained above, a portion of the liquor is separated from the wood chips by sieve 17 and withdrawn in conduit 19 to be recycled back to the top of the digester 11 after having added thereto necessary chemicals and wood chips.

The accurate monitoring of wood chips fed to the digester is accomplished by measuring the difference in density of the liquor flow feeding the chip to the digester before and after the chips have been introduced therein. The density of the liquor is measured by a gamma absorption device 27 just prior to when the chips are introduced into 13 and again by 23 just after the chips have been introduced. The resulting density measurements may then be fed, along with a total flow measurement from 29, to a computer which is programmed to modify the amount of fresh digester liquor fed to the system based on the amount of wood chips determined by the density and flow measurements. Here again, the excellent control of wood and fresh digester liquor resulting from the use of a means including a gamma absorption device is quite unexpected, as it could not have been predicted that there could be a significant and meaningful density variation between the digester liquor without chips (in 19) and the digester liquor containing the wood chips (in 25) to give an indication of amount of wood chips supplied in unit time.

As the wood chips and liquor progress down the length of the digester 11, through section b, delignification or cooking of the cellulosic material takes place. At the top of section b a side stream of cellulosic material and liquor is withdrawn in conduit 33 and pumped by pump 35 through heater 37 and conduit 39 back to the digester. The cellulosic material and liquor are heated to the delignification or cooking temperature by the heat added in heater 37. The temperature of the slurry withdrawn in conduit 33 is measured by means 36 and the temperature of the slurry in conduit 39 is measured by means 38 along with the flow rate of material in conduit 39 being measured by flow meter 40. The temperature and flow measurements together with the flow of steam to the heater are input to the computer which is programmed to determine the heat capacity of the wood chip liquor slurry. Alternatively, the heat capacity of the wood chip liquor slurry can be determined by measuring the temperature of the material being introduced to the digester in conduit 25, the temperature of the material withdrawn in conduit 33 and the heat added by the steam in heater 37. The quantity of material being heated between the top of the digester 11 and the withdrawn conduit 33 can be obtained by a mass balance around section a of the digester 11. The computer can easily be programmed to accomplish this mass balance and determine the heat capacity of the material in the digester.

At the lower end of section b, a sidestream of material can be recycled as shown through conduit 41, pump 43 and conduit 45 back to the digester 11 and the temperature of this side stream measured by means 42. Alternatively, a thermowell, thermocouple or other means (shown in dotted line at 42') for determining the temperature of the material at the lower end of section b could be utilized in place of the circulating side stream. The temperature of the material at the lower end of section b is input to the computer which is programmed to determine the heat of the exothermic delignification reaction.

In section c of digester 11, the delignified cellulosic material is washed by wash water which is introduced at the bottom of the digester 11 through conduit 49. The flow of water into the digester is controlled by the computer. In section c, the cellulosic material moves counter-currently with respect to the wash water. The wash water and the digesting liquors are withdrawn from the digester 11 through conduit 47.

A slurry of cellulosic material and water is withdrawn from the bottom of digester 11 in conduit 15 and sent to storage or for further processing. A gamma absorption device, a pressure reducer, a refractometer and a flow meter are installed in conduit 15 and as more fully explained above, the measurements from these devices are input to a computer which is programmed to determine the mass of cellulose being withdrawn and the amount of water being withdrawn from the bottom of the digester.

In operation, the digesting process is controlled by the amount of delignification desired in the cooking or delignification section of the digester. The computer performs a mass balancing of materials fed to and withdrawn from the digester. Specifically, the computer measures the mass of cellulose material being fed to the digester. The correct flow of digester chemicals is then determined and controlled by the computer. Withdrawal of digested pulp is controlled by the computer by balancing the mass of cellulosic material being fed to the reactor with that being withdrawn. The temperature rise of the reacting materials as they move through the cooking or delignification zone is measured and the computer determines the holdup time in the delignification section or cooking zone from the mass balance on materials fed to and from the digester. The computer then calculates the exothermic heat produced by the reaction. As explained heretofore, the amount of delignification is proportional to the exothermic heat produced by the delignification reaction. Having determined the amount of delignification occurring in the digester, the computer compares such with the set point or standard and adjusts the amount of cellulosic material being fed to the digester accordingly.

If the amount of delignification is less than that desired, the computer would reduce the amount of cellulosic material being fed to the digester and thus the holdup time in the cooking zone or delignification zone would be increased, thus increasing the amount of delignification taking place per unit of mass cellulosic material. In a similar manner, if the amount of delignification is in excess of that desired, the computer would increase the mass of cellulosic material being fed to the digester. The hold up time in the cooking zone would thus be reduced, and the delignification per unit of mass of cellulose material would also decrease.

It is to be understood that the present invention is not limited to the digesting chemicals or particular apparatus described herein, but can be applied equally well with other digesting chemicals and apparatus amenable to continuous operation in a single digester or vessel. Although only a single stage digesting process has been described herein, the present invention is understood not to be limited to such. The present invention is amenable to two stage continuous operations such as described in U.S. Pat. No. 3,200,032 as well. To permit such use of the present invention in a two stage digesting process, such as described in the above-mentioned patent 3,200,032, it is only necessary to determine the increase in temperature in each digesting stage.

It is also to be understood from the above description of the present process that many changes may be made without departing from the inventive scope thereof as defined in the following claims.

What is claimed is:

1. A continuous process for digesting cellulosic fibrous material in an elongated vertical continuous digester to provide pulp having a desired predetermined degree of delignification, comprising the steps of:

continuously charging cellulosic fibrous material into the top of the digester at a substantially constant rate;

impregnating the cellulosic fibrous material with digesting liquor;

while maintaining substantially steady-state conditions, treating the material with heated digesting liquor while passing the material through a digesting stage of the digester so that the material undergoes a delignification reaction and so that the material is delignified;

discharging the delignified material from the bottom of the digester at a substantially constant rate;

continuously determining the exothermic heat of the delignification reaction in the digesting stage, and thereby determining the degree of delignification occuring in the digesting stage, by (i) determining the temperature rise occurring during the delignification reaction in the digesting stage, which step is accomplished by measuring the temperature of fibrous material and liquid generally adjacent the top of the digesting stage, and measuring the temperature of fibrous material and liquid generally adjacent the bottom of the digesting stage, and (ii) by determining the heat capacity of the cellulosic material and digesting liquor in the digesting stage;

comparing the degree of delignification occurring in the digesting stage with the desired predetermined degree of delignification; and adjusting the amount of cellulosic fiber material continuously charged into the top of the digester to maintain the desired predetermined degree of delignification.

2. A process as recited in claim 1 wherein said step of measuring the temperature of fibrous material and liquid adjacent the top of the digesting stage is accomplished by withdrawing a quantity of material and liquid from a top portion of the digesting stage, measuring the temperature of the withdrawn quantity and passing the withdrawn quantity through a heater and then back into another top portion of the digester above the withdrawal level.

3. A process as recited in claim 2 wherein said step of determining the heat capacity of the cellulosic material and digesting liquor in the digesting stage is accomplished by determining the input of heat to said heater, measuring the flow of material and liquid from the heater back to the digester, and measuring the temperature of material and liquid flowing from the heater back to the digester.

4. A process as recited in claim 1 wherein said step of measuring the temperature of fibrous material and liquid adjacent the bottom of the digesting stage is accomplished by inserting a temperature measuring device within the digester adjacent the bottom of the digesting stage.

5. A process as recited in claim 1 wherein said step of measuring the temperature of fibrous material and liquid adjacent the bottom of the digesting stage is accomplished by withdrawing a quantity of material and liquid from a bottom portion of the digester, measuring the temperature of the withdrawn quantity and returning the withdrawn quantity to another bottom portion of the digesting stage above the withdrawal level.

* * * * *